US009884743B2

(12) United States Patent
Yoon et al.

(10) Patent No.: US 9,884,743 B2
(45) Date of Patent: Feb. 6, 2018

(54) VENTILATING APPARATUS FOR DISPLAY OF ELEVATOR HALL DOOR

(71) Applicant: DAJIT, Gyeonggi-do (KR)

(72) Inventors: Il Shik Yoon, Gyeonggi-do (KR); Jun Chan Yoon, Seoul (KR)

( * ) Notice: Subject to any disclaimer, the term of this patent is extended or adjusted under 35 U.S.C. 154(b) by 0 days.

(21) Appl. No.: 15/032,265

(22) PCT Filed: Oct. 22, 2014

(86) PCT No.: PCT/KR2014/009920

§ 371 (c)(1),
(2) Date: Apr. 26, 2016

(87) PCT Pub. No.: WO2015/064948

PCT Pub. Date: May 7, 2015

(65) Prior Publication Data

US 2016/0244297 A1 Aug. 25, 2016

(30) Foreign Application Priority Data

Oct. 28, 2013 (KR) ..... 10-2013-0128681

(51) Int. Cl.
*B66B 3/00* (2006.01)
*B66B 13/30* (2006.01)

(52) U.S. Cl.
CPC ..... *B66B 3/002* (2013.01); *B66B 3/008* (2013.01); *B66B 13/303* (2013.01)

(58) Field of Classification Search
CPC ..... B66B 3/002; B66B 3/008; B66B 13/303
(Continued)

(56) References Cited

U.S. PATENT DOCUMENTS

2012/0105424 A1* 5/2012 Lee ..... G09F 9/35 345/212
2017/0113899 A1* 4/2017 Hettema ..... B66B 3/008

FOREIGN PATENT DOCUMENTS

CN 204111131 U * 1/2015 ..... B66B 11/0226
CN 104386561 A * 3/2015 ..... B66B 11/0226
(Continued)

*Primary Examiner* — David Warren
(74) *Attorney, Agent, or Firm* — Richard John Bartz

(57) ABSTRACT

The present invention relates to a ventilating apparatus for ventilating a display of a hall door with clean air, and the ventilating apparatus includes: a rectangular parallelepiped monitor box MB which is fixed onto a rear surface of a hall door D at a rear side of an opening 15 of the elevator hall door D made of metal, and protrudes at the rear side of the elevator hall door D to accommodate a monitor M; a monitor M which is fixed into the monitor box MB; a tempered glass plate 20 which is disposed at the rear side of the opening 15 of the elevator hall door D, and sized to cover the entire monitor to protect the monitor M from frontal impact; a plurality of inlets and outlets 52 and 54 which is formed at a central lateral portion D1 of the hall door D and connected to the interior of the monitor box MB; and two blower fans F1 and F2 which are installed in the monitor box MB between the monitor M and the inlets and outlets 52 and 54, and provide air, in which when the blower fans F1 and F2 operate, air in a building hallway or an elevator cage flows into the monitor box MB through the inlets 52 among the inlets and outlets 52 and 54, cools the monitor M, and then is discharged to the building hallway or the cage through the outlets 54 among the inlets and outlets 52 and 54.

3 Claims, 6 Drawing Sheets

(58) Field of Classification Search
USPC ..... 187/396
See application file for complete search history.

(56) References Cited

FOREIGN PATENT DOCUMENTS

| | | | | | |
|---|---|---|---|---|---|
| JP | 2015024922 | A | * | 2/2015 | ..... B66B 3/00 |
| KR | 101269905 | B1 | * | 5/2013 | |
| KR | 101334452 | B1 | * | 11/2013 | ..... B66B 3/00 |
| KR | 101402056 | B1 | * | 6/2014 | ..... B66B 13/303 |
| KR | 101607390 | B1 | * | 3/2016 | |

* cited by examiner

[Fig. 1]
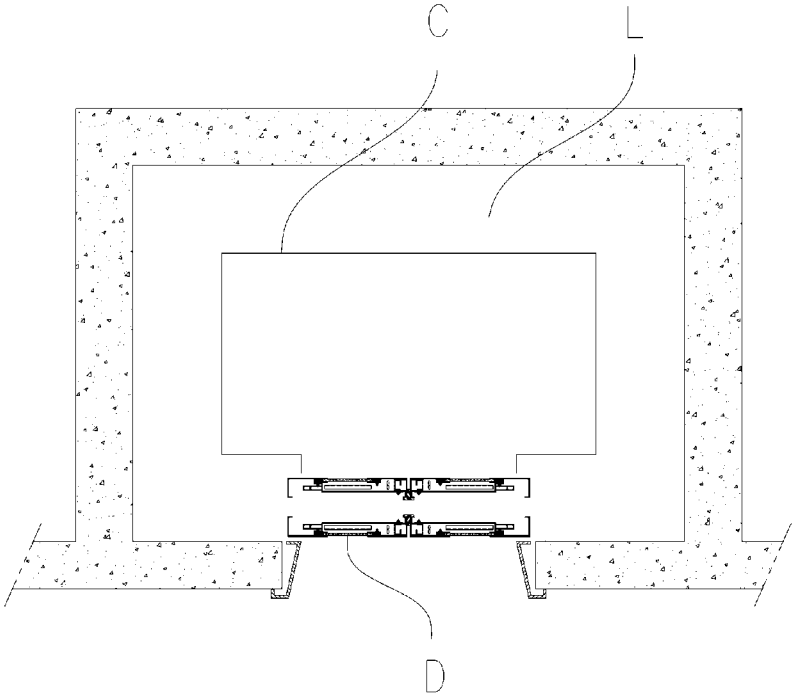

[Fig. 2]
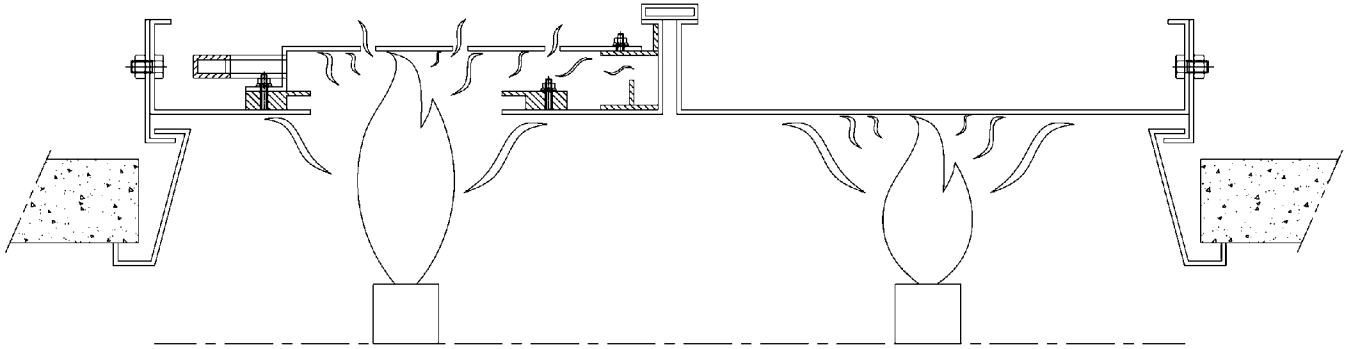

[Fig. 3]
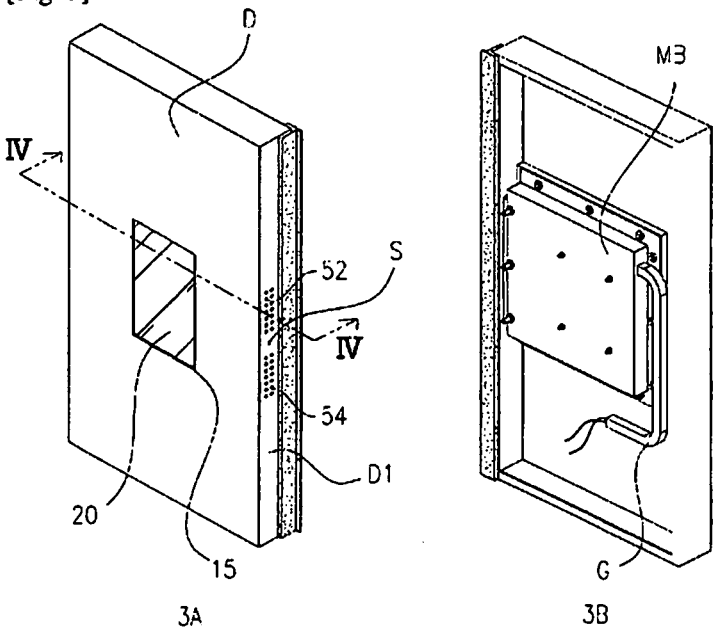
[Fig. 4]
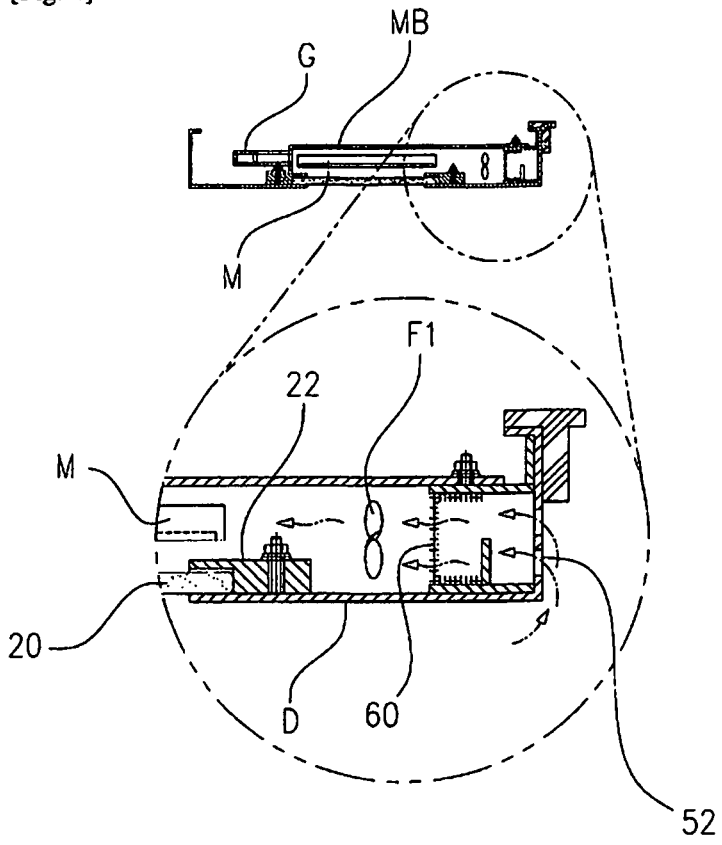

[Fig. 5]
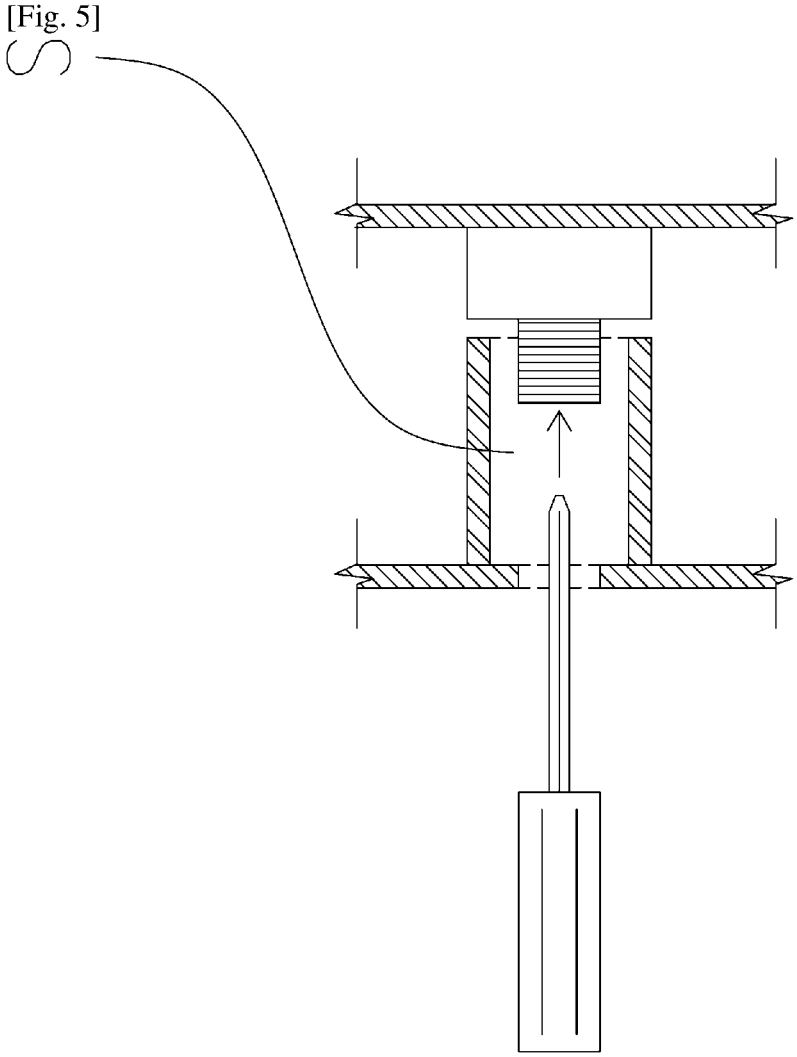

[Fig. 6]
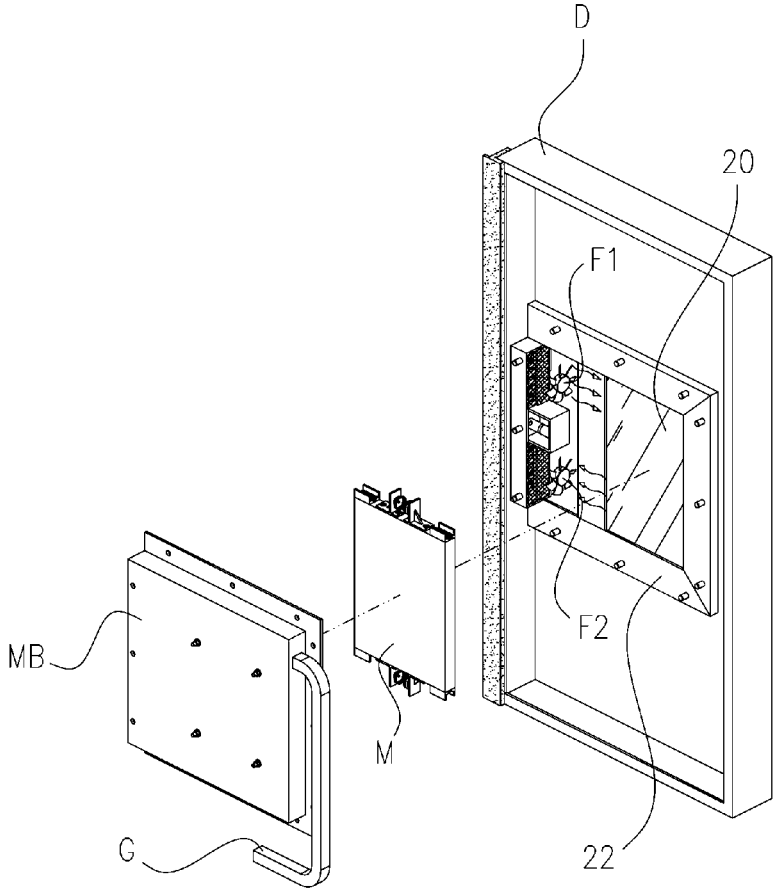

[Fig. 7]
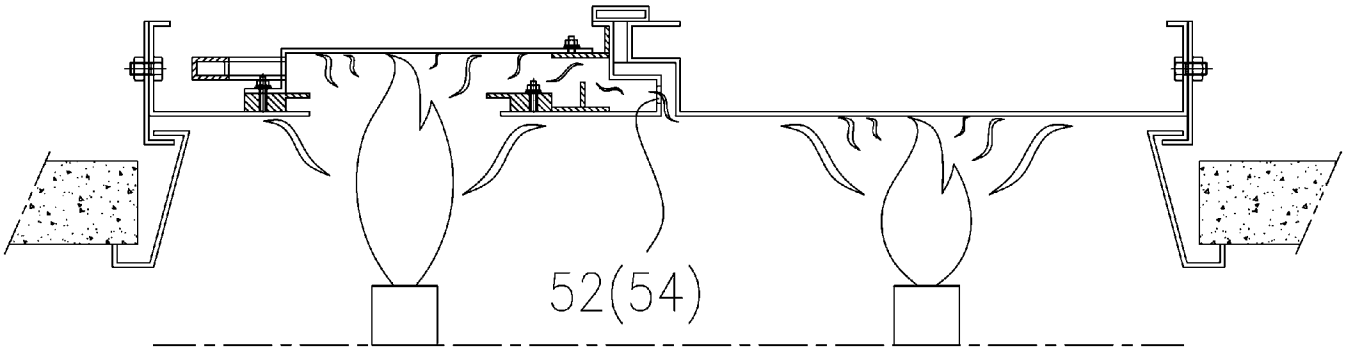

VENTILATING APPARATUS FOR DISPLAY OF ELEVATOR HALL DOOR

TECHNICAL FIELD

The present invention relates to a ventilating apparatus for a display of an elevator hall door, and more particularly, to a ventilating apparatus for ventilating a display of a hall door with clean air.

BACKGROUND ART

FIG. 1 is a cross-sectional view illustrating a relationship between a cage C and an elevator shaft L of the existing elevator. Recently, instances in which displays for providing passengers with information are installed on a hall door D at a hallway side of an elevator or a cage door at a cage side are gradually increasing. This display device needs to be separately equipped with a ventilating apparatus for cooling heat generated in a monitor. Meanwhile, the elevator shaft L, which is a passageway through which the elevator cage C moves upward and downward, is a nearly hermetic space isolated from the outside thereof, and because of frequent upward and downward movements of the elevator cage, the space is usually and nearly always filled with contaminated air containing a large amount of dust or foreign substances. For this reason, there is great concern that the monitor of the display will erroneously operate or break down due to dust or foreign substances included in air in a case in which air in the elevator shaft L is used to cool the display installed on the elevator hall door D. Hereinafter, the hall door of the elevator at the hallway side is referred to as an "elevator hall door" or simply a "hall door".

Meanwhile, the interior of the elevator shaft and the cage of the elevator, which are used in a typical building, need to necessarily have a fireproof structure. In particular, in order to prepare for a risk of a fire, the elevator hall door needs to necessarily have a fireproof function to meet fire regulations. FIG. 2 is a schematic cross-sectional view illustrating how the existing typical flat hall door and the hall door equipped with the display exhibit a fireproof function in the event of a fire. As illustrated, because the typical door at the right side is configured by a flat metallic plate, there is no problem with the fireproof function.

However, in the case of the hall door at the left side which has the display installed thereon, ventilation openings for cooling the monitor are formed in a monitor box and communicate with the cage at a rear side, and as a result, flame may be concentrated on a concave portion through a front opening of the display, and then spread over the interior of the cage through the ventilation openings, such that there is a problem in that the hall door at the left side is vulnerable to a fire. That is, there is a problem in that the hall door at the left side has the structure in which the flame is concentrated on a concave portion of the display and then spread over the interior of the cage, and thus is very vulnerable to a fire, and this structure is extremely difficult to be used for the elevator.

DISCLOSURE

Technical Problem

The present invention has been made by taking into account of the aforementioned problems in the related art, and a main object of the present invention is to prevent a malfunction or a breakdown of a monitor of a display caused by contaminated air, by cooling the monitor of the display installed on an elevator hall door by using clean air in a cage or a hallway instead of using contaminated air in an elevator shaft.

Another object of the present invention is to improve a fireproof function at the display of the elevator hall door by discharging hot air concentrated on the display to the outside rather than to the elevator cage in the event of a fire.

Technical Solution

To achieve the aforementioned objects of the present invention, the present invention provides a ventilating apparatus for a display of an elevator hall door, the ventilating apparatus including: a rectangular parallelepiped monitor box MB which is fixed onto a rear surface of a hall door D at a rear side of an opening 15 of the elevator hall door D made of metal, and protrudes at the rear side of the elevator hall door D to accommodate a monitor M; a monitor M which is fixed into the monitor box MB; a tempered glass plate 20 which is disposed at the rear side of the opening 15 of the elevator hall door D, and sized to cover the entire monitor to protect the monitor M from frontal impact; a plurality of inlets and outlets 52 and 54 which is formed at a central lateral portion D1 of the hall door D and connected to the interior of the monitor box MB; and two blower fans F1 and F2 which are installed in the monitor box MB between the monitor M and the inlets and outlets 52 and 54, and provide air, in which when the blower fans F1 and F2 operate, air in a building hallway or an elevator cage flows into the monitor box MB through the inlets 52 among the inlets and outlets 52 and 54, cools the monitor M, and then is discharged to the building hallway or the cage through the outlets 54 among the inlets and outlets 52 and 54.

In the ventilating apparatus according to the present invention, an insect screen 60 may be installed between the inlets and outlets 52 and 54 and the blower fans F1 and F2.

In addition, the ventilating apparatus according to the present invention may further include a switch S which is connected to the blower fans F1 and F2 and the monitor M to stop operations of the blower fans and the monitor.

Advantageous Effects

According to the ventilating apparatus for a display of an elevator hall door according to the present invention, which is configured as described above, the monitor may be cooled by clean air, thereby preventing a malfunction and a breakdown of the monitor and improving a fireproof function.

DESCRIPTION OF DRAWINGS

FIG. 1 is a cross-sectional view illustrating a relationship between a cage C and an elevator shaft L of the existing elevator.

FIG. 2 is a schematic cross-sectional view illustrating how the existing typical flat hall door and the hall door equipped with the display exhibit a fireproof function in the event of fire.

FIGS. 3A and 3B are a front perspective view and a rear perspective view of an elevator hall door D implementing the present invention, and FIG. 4 is a cross-sectional view taken along line IV-IV in FIG. 3A, and a partially enlarged view.

FIG. 5 is a partially cross-sectional view illustrating a stop switch S of a monitor and a blower fan.

FIG. 6 is an exploded perspective view when viewed from a rear side of the hall door D for the purpose of better understanding of the present invention.

FIG. 7 is a cross-sectional view illustrating an example of the present invention which corresponds to FIG. 2.

BEST MODE

FIGS. 3A and 3B are a front perspective view and a rear perspective view of an elevator hall door D implementing the present invention, and FIG. 4 is a cross-sectional view taken along line IV-IV in FIG. 3A, and a partially enlarged view.

As illustrated in FIGS. 3 to 4, a rectangular parallelepiped monitor box MB, which protrudes at a rear side of an elevator hall door and accommodates a monitor M, is fixed onto a rear surface of the hall door D at a rear side of an opening 15 of the elevator hall door D made of metal. The monitor M is fixed into the monitor box MB, and electric wires connected to the monitor are extended to the outside of the monitor box MB through an electric guide G having a fireproof structure, and then connected to a power supply or a controller. In addition, a tempered glass plate 20, which is sized to cover the entire monitor to protect the monitor from external impact, is installed between the monitor M and the rear side of the opening 15 of the elevator hall door D. The tempered glass plate 20 is fixed to the hall door D by means of a glass plate support 22.

As illustrated in FIG. 3A and an enlarged view of FIG. 4, a plurality of inlets 52 and a plurality of outlets 54 are formed at a central lateral portion D1 of the hall door D, and the inlets and outlets 52 and 54 are connected with the interior of the monitor box MB. In the drawings, the inlets 52 and the outlets 54 are formed in two rows one above or below another, respectively, but the positions of the inlets and the outlets may be changed as necessary (e.g., upper holes may be the outlets and lower holes may be the inlets), and the inlets 52 and the outlets 54 may be formed in a single row, three rows, or four rows instead of the two rows, respectively. The inlets and the outlets need to be formed within a range in which the inlets and the outlets do not degrade support strength of the elevator hall door, particularly, the central lateral portion D1. Here, the central lateral portion D1 refers to a lateral side where two elevator hall doors meet together.

In addition, two blower fans F1 and F2, which provide air between the monitor M and the inlets and outlets 52 and 54, are installed in the monitor box MB. The blower fan F1 illustrated in FIG. 4 is a blower fan for drawing air, and when the blower fan F1 operates, air cools the monitor M while flowing through the inlets 52 as indicated by the arrows. That is, when the two blower fans F1 and F2 for drawing air and for discharging air operate, fresh and clean air in a building hallway or an elevator cage flows into the monitor box MB through the inlets 52, cools the monitor M, and then is discharged back into the building hallway or the cage through the outlets 54.

Meanwhile, if insects such as mosquitoes or flies or foreign substances are introduced into the drawn air, and then enter the monitor M, a malfunction or a breakdown of the monitor is caused, and thus it is preferred to prevent the introduction of the insects or the foreign substances. To this end, in the present invention, an insect screen 60 is installed between the blower fans F1 and F2 and the inlets and outlets 52 and 54. In this case, the drawn air is filtered while passing through the insect screen 60, thereby preventing insects or foreign substances from entering the monitor.

In general, an elevator installed in a building is used only to mostly transport luggage when people initially move into the building. Under an environment in which the elevator is used only for the transportation of luggage instead of passengers, air at the periphery of the elevator is inevitably contaminated further than usual. Under this environment, it is preferred to stop the ventilating apparatus for the purpose of safety of the monitor. In addition, there may be a situation in which the monitor as well as the ventilating apparatus may be stopped manually as necessary. The present invention uses a switch S which forcedly stops the blower fans and the monitor in order to prepare for the aforementioned situations. FIG. 5 is a partial cross-sectional view illustrating an emergency stop switch S. When the switch S is operated, the blower fans F1 and F2 and the monitor M are stopped, and because the connection relationship between the switch S, the blower fans F1 and F2, and the monitor M is easily understood by those skilled in the art according to the present invention, a detailed description thereof will be omitted. Any switch may be used as the switch S, but a push button type switch may be used (see FIG. 5) for convenience for an operator, particularly, so that an operator who transports luggage may easily operate the push button type switch by pushing the push button type switch in the direction indicated by the arrow. For the purpose of convenience of an operation and in order to provide access restriction so that only authorized person operates the switch S, the switch S is preferably disposed between the inlets and the outlets at the central lateral portion D1 of the hall door (see FIG. 3A), but the present invention is not necessarily limited thereto, and the switch S may be disposed at other locations as necessary.

FIG. 6 is an exploded perspective view when viewed from a rear side of the hall door D for the purpose of better understanding of the present invention. As illustrated, air, which has flown in the direction indicated by the arrows, cools the monitor M, and then is discharged in the direction indicated by the arrows. Meanwhile, in some instances, no blower fans F1 and F2 are installed, and a cooling method using natural convection of air may be used.

FIG. 7 is a cross-sectional view illustrating an example of the present invention which corresponds to FIG. 2. The right side is a flat door in the related art, and the left side is a hall door having a display installed thereon to which the present invention is applied. As illustrated, in the case of the structure to which the present invention is applied, flame may be discharged to the outside of the monitor box MB through the inlets and outlets 52 and 54, which are formed at a lateral side of the hall door, instead of a rear side of the hall door D, thereby preventing the flame from being spread over the interior of the elevator cage, and as a result, it is possible to implement a sufficient fireproof function for preparing for a fire.

The invention claimed is:

1. A ventilating apparatus for a display of an elevator hall door the ventilating apparatus comprising:

a rectangular parallelepiped monitor box (MB) which is fixed onto a rear surface of a hall door (D) at a rear side of an opening (15) of the elevator hall door (D) made of metal, and protrudes at the rear side of the elevator hall door (D) to accommodate a monitor (M);

a monitor (M) which is fixed into the monitor box (MB);

a tempered glass plate (20) which is disposed at the rear side of the opening (15) of the elevator hall door (D), and sized to cover the entire monitor to protect the monitor (M) from frontal impact;

a plurality of inlets and outlets (52 and 54) which is formed at a central lateral portion (D1) of the hall door (D) and connected to the interior of the monitor box (MB); and two blower fans (F1 and F2) which are installed in the monitor box (MB) between the monitor (M) and the inlets and outlets (52 and 54), and provide air, wherein when the blower fans (F1 and F2) operate, air in a building hallway or an elevator cage flows into the monitor box (MB) through the inlets (52) among the inlets and outlets (52 and 54), cools the monitor (M), and then is discharged to the building hallway or the cage through the outlets (54) among the inlets and outlets (52 and 54).

2. The ventilating apparatus of claim 1, wherein an insect screen (60) is installed between the inlets and outlets (52 and 54) and the blower fans (F1 and F2).

3. The ventilating apparatus of claim 1, further comprising:

a switch (S) which is connected to the blower fans (F1 and F2) and the monitor (M) to stop operations of the blower fans and the monitor.

* * * * *